US008791398B2

(12) United States Patent
De la Cuerda Ortin et al.

(10) Patent No.: US 8,791,398 B2
(45) Date of Patent: Jul. 29, 2014

(54) HOB HAVING AT LEAST ONE COOKING ZONE AND METHOD FOR OPERATING A HOB

(75) Inventors: Jose Maria De la Cuerda Ortin, Zaragoza (ES); Ignacio Garde Aranda, Zaragoza (ES); Oscar Gracia Campos, Zaragoza (ES); Pablo Jesus Hernandez Blasco, Cuarte de Huerva (ES); Sergio Llorente Gil, Zaragoza (ES); Paul Muresan, La Cartuja (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/581,651

(22) PCT Filed: Feb. 9, 2011

(86) PCT No.: PCT/EP2011/051851

§ 371 (c)(1),
(2), (4) Date: Aug. 29, 2012

(87) PCT Pub. No.: WO2011/107328

PCT Pub. Date: Sep. 9, 2011

(65) Prior Publication Data

US 2012/0321761 A1 Dec. 20, 2012

(30) Foreign Application Priority Data

Mar. 3, 2010 (ES) ..... 201030314

(51) Int. Cl.
*H05B 6/12* (2006.01)
*H05B 6/06* (2006.01)

(52) U.S. Cl.
CPC ..... *H05B 6/062* (2013.01); *H05B 6/065* (2013.01); *H05B 2213/05* (2013.01)
USPC ..... 219/620

(58) Field of Classification Search
USPC ..... 219/620, 483, 447.1, 621–622, 219/660–661, 452.12, 624–626, 671–672
See application file for complete search history.

(56) References Cited

U.S. PATENT DOCUMENTS

| | | | | |
|---|---|---|---|---|
| 5,319,174 | A | 6/1994 | Omori et al. | |
| 5,714,739 | A * | 2/1998 | Irrera et al. | 219/626 |
| 6,498,325 | B1 * | 12/2002 | Akel et al. | 219/624 |
| 6,770,857 | B2 * | 8/2004 | Hirota et al. | 219/626 |
| 6,930,287 | B2 * | 8/2005 | Gerola et al. | 219/447.1 |
| 7,227,103 | B2 * | 6/2007 | Esteras Duce et al. | 219/443.1 |

(Continued)

FOREIGN PATENT DOCUMENTS

EP 1768258 A2 3/2007

OTHER PUBLICATIONS

International Search Report PCT/EP2011/051851.

*Primary Examiner* — Dana Ross
*Assistant Examiner* — Renee L Miller
(74) *Attorney, Agent, or Firm* — James E. Howard; Andre Pallapies

(57) ABSTRACT

An induction cooktop includes a cooking zone, and a circuit arrangement for operating the cooking zone. The circuit arrangement has a parallel circuit, in which two inductors are connected in parallel manner. An apparatus is configured to detect occupancy of at least one cooking sub-zone of the cooking zone by a food preparation vessel and includes a current measuring element which is connected in series to the parallel circuit.

20 Claims, 1 Drawing Sheet

(56) References Cited

U.S. PATENT DOCUMENTS

| | | | | |
|---|---|---|---|---|
| 7,425,690 | B2 * | 9/2008 | Schilling | 219/451.1 |
| 7,504,607 | B2 * | 3/2009 | Barragan Perez et al. | 219/624 |
| 7,795,562 | B2 * | 9/2010 | de Rooij et al. | 219/624 |
| 8,030,601 | B2 * | 10/2011 | Llorente Gil | 219/620 |
| 8,350,194 | B2 * | 1/2013 | Lee et al. | 219/460.1 |
| 2002/0053563 | A1 * | 5/2002 | Pastore et al. | 219/448.11 |
| 2004/0144769 | A1 * | 7/2004 | Pastore | 219/447.1 |
| 2005/0051533 | A1 * | 3/2005 | Yang et al. | 219/483 |
| 2005/0127065 | A1 * | 6/2005 | de Rooij et al. | 219/624 |
| 2006/0081616 | A1 * | 4/2006 | Schuler | 219/625 |
| 2006/0086728 | A1 * | 4/2006 | Kim | 219/626 |
| 2006/0118549 | A1 * | 6/2006 | Fishman et al. | 219/656 |
| 2006/0118550 | A1 * | 6/2006 | de Rooij et al. | 219/662 |
| 2007/0084857 | A1 * | 4/2007 | Osaka | 219/660 |
| 2007/0102420 | A1 * | 5/2007 | Miyauchi et al. | 219/626 |
| 2007/0125771 | A1 | 6/2007 | Uchida et al. | |
| 2007/0164017 | A1 * | 7/2007 | Gouardo et al. | 219/626 |
| 2008/0049470 | A1 * | 2/2008 | Ishio et al. | 363/78 |
| 2008/0164249 | A1 | 7/2008 | Llorente Gil | |
| 2009/0008384 | A1 * | 1/2009 | Roux | 219/622 |
| 2009/0014440 | A1 * | 1/2009 | Miyauchi et al. | 219/661 |
| 2009/0120928 | A1 * | 5/2009 | Lee et al. | 219/626 |
| 2009/0139986 | A1 * | 6/2009 | Lee et al. | 219/622 |
| 2009/0212042 | A1 * | 8/2009 | Lee et al. | 219/624 |

* cited by examiner

HOB HAVING AT LEAST ONE COOKING ZONE AND METHOD FOR OPERATING A HOB

BACKGROUND OF THE INVENTION

The invention relates to a cooktop having at least one cooking zone and to an apparatus for detecting a food preparation vessel on the cooking zone. The invention also relates to a method for operating a cooktop.

Cooktops which have a number of cooking zones are known from the prior art. Considered in isolation, each cooking zone is heated by a heating element which is disposed below a support plate of the cooktop, on which food preparation vessels can be placed. In this context cooktops are known in which a cooking zone is able to be heated by a number of heating units running within one another, which are configured for example as circular heating elements or induction coils. This enables the cooking zone to be heated over an individual surface with heating elements configured within one another and with a different radius.

The detection of the space occupied by a pot is significant precisely with regard to the individual activation and deactivation of these types of separate heating units. It enables the position and size of the surface covered by a food preparation vessel when placed on the support plate to be detected.

A circuit arrangement for evaluating a sensor state is known from EP 1 768 258 A2, by means of which a corresponding positioning of a pot on a cooktop is able to be detected.

The known cooking zones of a cooktop are restricted in respect of their size and in addition are functionally restricted in respect of the arrangement of the heating units as well as their individual mode of operation.

A heating facility for an induction cooker is known from WO 2006/092179 A1. It comprises a circuit arrangement with a number of inductors which can be connected to each other in different ways. The heating facility has at least a first resonant circuit for this purpose which comprises at least a first and a second inductor for transmission of heat energy to an element to be heated and a first circuit for exciting the first resonant circuit and for supplying the heat energy to the inductors. Furthermore the heating facility has a switching means, by means of which the heat energy is optionally able to be supplied to just one of the inductors or simultaneously to both inductors in a parallel circuit.

BRIEF SUMMARY OF THE INVENTION

The object of the present invention is to create an induction cooktop as well as a method for operating such an induction cooktop by means of which a cooking zone configured with a large surface can be operated in an energy-efficient manner and the pots can occupy the space in an improved manner.

An inventive induction cooktop comprises a circuit arrangement for operating a cooking zone of the induction cooktop. The circuit arrangement comprises a parallel circuit in which two inductors are connected in a parallel manner. Connected in series to the parallel circuit is a current measuring element. The induction cooktop also comprises an apparatus for detecting the occupancy of at least one cooking sub-zone of the overall cooking zone by a food preparation vessel. This apparatus for occupancy detection comprises the current measuring element. This type of embodiment of the induction cooktop on the one hand enables more energy-efficient operation. In particular this type of embodiment makes possible a simplified circuit design with reduced numbers of components, since for the majority of inductors only one single current measuring element is required to enable occupancy of the cooking sub-zone, which is able to be heated with the respective inductors, to be detected. This also makes possible a quite specific mode of operation for pot occupancy detection.

In one inventive embodiment provision is made for the cooking zone to be able to be heated by at least three inductors disposed adjacent to one another and for two inductors to be able to be supplied with electrical energy with a first driver circuit and the at least third inductor to be able to be supplied with energy with a separate second driver circuit, an inductor being able to be activated by way of said inductor as a function of the detection of a food preparation vessel on the cooking zone.

In respect of the formulation of the ability of a cooking zone to be heated with an inductor, it should be noted that this covers the fact that the electromagnetic interaction of a coil of the inductor with a suitable metallic material of a food preparation vessel produces corresponding heating of the food preparation vessel. Precisely this specific physical basis is also covered in the context of the invention by the formulation of the ability of a cooking zone or a surface thereof or a cooking sub-zone to be heated with an inductor.

In addition the formulation of an adjacent arrangement of the inductors refers to a type of positioning, in which the inductors are positioned alongside one another. Thus this is to be understood as an arrangement in which the surfaces formed by the inductors on the cooktop plate disposed above are disposed adjacent to one another and do not partly overlap or even one surface is completely enclosed by the other. This would be the case with inductors configured with a different radius which are disposed radially within one another, which is not intended to be covered here.

The induction cooktop is preferably also configured with a circuit arrangement, which has two separate driver circuits, with the at least three heating units in the form of the inductors being operated and supplied with energy by the two driver circuits. This embodiment also allows the at least three inductors to be assigned functionally to and supplied in a correspondingly individual manner with energy by said two driver circuits. On the one hand this design allows a cooking zone with a particularly large surface to be created, since the inductors are not positioned within one another but adjacent to one another, and additionally the number with at least three inductors is so great that a particularly large heatable surface can be produced.

The inventive induction cooktop and the specific circuit design also ensure that all the inductors do not always have to be activated at the same time, thereby saving energy, as corresponding surfaces are not heated unnecessarily when no food preparation vessel is positioned on them. In this preferred embodiment a cooking zone with a particularly large surface can be created by the induction cooktop, which can also be operated in a specific manner so that only individual cooking sub-zones, which can be formed in turn from secondary zones, are activated and heated as required, as a function of their respective occupancy by a food preparation vessel. On the one hand this ensures that a correspondingly large cooking zone is available for particularly large food preparation vessels, which can be heated in a regular over its entire surface, so that even the very large food preparation vessel can be heated correspondingly in a regular manner. However if a smaller food preparation vessel is placed on this large cooking zone, it is detected by the circuit engineering principle and the apparatus for detecting zone occupancy that only a small surface of this large cooking zone is occupied, said small surface then being able to be heated individually.

A fourth inductor is preferably provided in addition to the three inductors, being assigned to the cooking zone and also being supplied with energy by the second driver circuit. In particular therefore two driver circuits are provided, to each of which two inductors are assigned for the supply of energy. The configuration of the surface of the cooking zone and the individual electronic mode of operation can thus be adjusted and coordinated in a particular manner. The overall cooking zone can thus be formed from two cooking sub-zones in a specific operating mode of the induction cooktop. Each of these two cooking sub-zones preferably again comprises at least two secondary zones. Each of these secondary zones is able to be heated in particular by an inductor. Provision is thus made in particular for the two inductors of the secondary zones of the first cooking sub-zone to be able to be supplied with energy by the first driver circuit and for the two inductors of the secondary zones of the second cooking sub-zone to be able to be supplied with energy by the second driver circuit.

Provision is preferably made for an inductor, in particular all inductors, of the cooking zone to have a single coil each. Provision is therefore not made with this embodiment for each heating unit in the form of an inductor to have a number of coils configured within one another, which can then be activated and deactivated separately, but for only a single coil to be provided, which can then be activated and deactivated. In terms of circuit engineering this allows a relatively simple and robust embodiment. Also the entire surface can be heated in a regular manner with the heating unit in this context.

As far as their winding shape is concerned, the heating units are preferably wound in an oval, so that the cooking zone comprises at least three, in particular four adjacently configured and directly adjoining oval secondary zones. This specific shape allows particularly regular cover over a large surface and therefore also heating of the overall cooking zone surface to be achieved. This produces particularly impressive cooking results.

The first driver circuit preferably comprises a first half bridge, which is connected electrically in series to two parallel relays. Provision is therefore made in particular for a first half bridge circuit of the first driver circuit to be connected to a first signal path, in which the first relay and the first heating unit are connected. This first circuit path is connected parallel to a second circuit path, in which a second relay and the second heating unit are connected.

The second driver circuit is embodied correspondingly, likewise having a half bridge circuit connected in series to a parallel circuit, the parallel circuit in each instance here also having a circuit path with a relay and, connected in series thereto, a heating unit.

This embodiment allows a design that is relatively simple in terms of circuit engineering to be provided, which also allows the occupancy of specific regions of the cooking zone by a food preparation vessel to be detected in a particularly simple and reliable manner in conjunction with the apparatus for detecting a food preparation vessel on the cooking zone. In particular such a circuit structure allows quite specific sequential strategies to be adopted to detect occupied sub-regions of the cooking zone. With cooking zones of such a large size it is therefore also essential to allow a particularly effective and targeted search strategy in respect of the regions of said large cooking zone that are occupied. This is also particularly advantageously ensured and supported by the circuit engineering principle.

The heating units connected to the first driver circuit can preferably be activated and deactivated independently of one another. This also allows heating units assigned to a driver circuit and connected to said driver circuit functionally for the supply of energy to be activated and deactivated separately, allowing the heating of sub-surfaces of cooking zones in a particularly flexible and variable manner.

The overall surface of the cooking zone with at least three heating units is preferably larger than half the depth of the support plate of the cooktop and/or larger than or equal to half the width of the support plate.

The invention also relates to a method for operating a cooking zone of the induction cooktop, which is formed from at least two cooking sub-zones and each cooking sub-zone can be heated by an assigned inductor, the inductors being connected in a parallel manner in a parallel circuit. A current measuring element is connected in series to the parallel circuit and occupancy of a cooking sub-zone by a food preparation vessel is detected from the current values of the current measuring element. Such a method allows a circuit with a very much reduced number of components to enable pot detection in a reliable and safe manner.

A multistage search method is preferably performed to detect occupancy of the overall cooking zone. Such a mode of operation allows the occupancy of cooking sub-zones by a food preparation vessel to be detected in a particular precise and accurate manner. This is possible according to the present invention precisely because the cooking zone is formed from a number of cooking sub-zones and therefore it is possible to determine precisely on which of the cooking sub-zones a food preparation vessel is located. Such a multistage search operation therefore allows precise locational occupancy detection on the cooking zone to be improved. This produces a better operating response, as more precise detection also allows more precise information to be obtained about the inductors that have to be activated to heat the specifically occupied cooking sub-zone. This also means that the cooktop is operated in a more energy-efficient manner.

A switching element is preferably connected in series to every inductor in the parallel circuit and in a first search step of the search method both switching elements are closed to detect occupancy on the overall cooking zone. Basic occupancy of the cooking zone by one or more food preparation vessels is detected from the current value at the current measuring element, this being detected independently of the precise location of the food preparation vessel on the cooking zone. Therefore in a first step it is first simply established whether there is any food preparation vessel present at all on the cooking zone, with the precise locational position of the food preparation vessel not yet being determined in this context. Such a mode of operation therefore allows it to be detected very quickly whether any food preparation vessel at all is in place.

If such detection of a food preparation vessel anywhere on the cooking zone is established, in a further subsequent search step the switching element connected in series to a first inductor remains closed. The switching element connected in series to the second inductor is then opened. It is then detected from the current value at the current measuring element whether the first cooking sub-zone is occupied by a food preparation vessel. In a further subsequent search step the switching element connected in series to the first inductor is then opened and the switching element connected in series to the second inductor is closed. In this instance too it is detected from the current value at the current measuring element whether the second cooking sub-zone is occupied by a food preparation vessel. These specific search steps allow the very precise detection of where a food preparation vessel is positioned with locational accuracy on the cooking zone.

After occupancy detection the inductor(s), on the assigned cooking sub-zone(s) of which occupancy by a food preparation vessel has been detected is/are supplied with energy. In this context the switching elements connected in series to the respective inductors are closed in the parallel circuit. This allows energy to be supplied to the inductors.

The cooktop is preferably configured in such a manner that the one cooking zone can be heated by at least three adjacently disposed inductors. Two inductors are supplied with electrical energy with a first driver circuit. The at least third inductor can be supplied with energy with a separate second driver circuit and is not connected to the first driver circuit and cannot be supplied with energy with the first driver circuit. An inductor is activated by way of the driver circuit as a function of the detection of a food preparation vessel on the cooking zone at a locationally specific position. This allows a quite specific method for operating a quite specifically embodied cooking zone of a cooktop, so that a particularly large cooking zone can be operated particularly effectively in respect of its surface embodiment. Also the individual adjacently configured inductors can be activated and deactivated in a highly individual and variable manner.

To detect occupancy of a cooking zone region by a food preparation vessel, occupancy of the overall first zone surface that can be heated by the first two heating units is preferably checked independently of specific occupancy of a first secondary zone that can be heated by the first heating unit and a second secondary zone that can be heated by the second heating unit. The mode of operation in respect of the detection of occupancy of the cooking zone by a food preparation vessel is achieved efficiently in a strategic manner with different method sequences and method steps to be performed in respect of the specific size of the cooking zone. According to the preferred embodiment in a first step this requires a method process in which the majority of the individual heating units are not examined at this stage in respect of occupancy thereon but in a superordinate search strategy the heating units assigned to a driver circuit and the overall surface that can be heated therewith, specifically the first zone surface, are generally examined first for occupancy. Therefore in this first step there is no detailed search to determine whether a food preparation vessel is positioned on an individual heating unit or on a surface of the cooking zone above each individual heating unit. This allows the process for detecting occupancy of the cooking zone to proceed more quickly and accurately.

In particular, when occupancy of the first zone surface by a food preparation vessel is detected, a check is then performed to determine the secondary zone on which the food preparation vessel is disposed and, based on this, the most suitable heating unit for heating the surface occupied by the food preparation vessel is activated with the first driver circuit. According to this advantageous embodiment, this is detected when it is identified for example that a food preparation vessel is positioned somewhere on the first zone surface. In a further step the further exact occupancy is checked to determine the secondary zone of this first zone surface on which the food preparation vessel is disposed. Only if a food preparation vessel is detected in a general sub-zone of the overall cooking zone, specifically the first zone surface, is it then checked in detail in a further step where precisely the food preparation vessel is located in this first zone surface. This is then identified and the most suitable heating unit is activated, which means that the respective heating unit of the two first heating units provided to heat the first zone surfaces is activated, on which the food preparation vessel is actually positioned. If the vessel is located on both heating units assigned to the first driver circuit, both heating units are activated. If the vessel is only located on one of the two heating units, only this one is activated by the driver circuit and the other heating unit is deactivated by the first driver circuit.

In a corresponding embodiment this also applies to the at least third heating unit and the second driver circuit, with the same applying in a similar manner to the explanation relating to the first driver circuit with the first heating units in an advantageous embodiment, if the second driver circuit likewise supplies two separate heating units with energy.

To detect occupancy of a cooking zone region by a food preparation vessel, an occupancy check of the overall second zone surface that can be heated by the heating units connected to the second driver circuit is preferably performed at the same time as the occupancy check for the first zone surface.

This allows a particularly efficient and fast occupancy check to be performed on the overall cooking zone, in particular if said occupancy check method is a multistage method, as described above, which examines the overall cooking zone surface more closely in steps, if a food preparation vessel positioned thereon is detected in first general steps and checks on the larger zone surfaces.

If a second food preparation vessel is additionally placed on the cooking zone adjacent to a first food preparation vessel that has already been positioned and can be heated with at least one activated heating unit, a further occupancy check process is preferably started. If a food preparation process is already under way and at least one heating unit has been activated by the functionally assigned driver circuit, an at least further food preparation vessel can subsequently be positioned on said cooking zone and a further occupancy check process takes place. The already activated heating unit then remains in the active state and the remaining surface regions of the cooking zone, which were not occupied during the first occupancy check process in particular are checked for occupancy. This takes place in particular also according to the staged occupancy check method referred to above.

The further occupancy check process is preferably started by the user by actuating an operating element. Unwanted activation of heating units can thus be prevented, so that safety-critical operating states do not occur.

This in particular provides a method with which, with a relatively large cooking zone, which has at least three adjacently disposed heating units, which are operated by at least two separate driver circuits, a staged occupancy check method is performed and it is identified in a particularly efficient manner from this which heating units have to be activated in order to be able to heat the occupied surface regions. To this end the cooking zone is first divided generally into zone surfaces, which can be heated by the heating units connected to the separate driver circuits. Only if occupancy is detected on one of said zone surfaces is said zone surface searched further in greater detail, to determine which secondary zone of said zone surface is actually occupied by a food preparation vessel. When this secondary zone is detected, the most suitable heating unit for heating said secondary zone is activated.

Provision is made in particular, in respect of a first method step, for the cooking zone surface to be divided into a corresponding identical number of zone surfaces based on the number of driver circuits present, independently of the number of heating units which can be used to heat each of said zone surfaces. It is thus first checked in a superordinate manner independently of the number of heating units per zone surface in a method step whether food preparation vessels have been placed on one or more of said zone surfaces. Only if it is detected on a zone surface that a food preparation vessel has been placed thereon, is it checked more precisely in a further method step within said zone surface where said food preparation vessel is actually located. To this end the heating units which can heat said zone surface are checked in respect of the locational positions of the secondary zones they can heat for occupancy by the food preparation vessel, this being performed in particular consecutively in a time sequence.

The search is in particular performed simultaneously in the zone surfaces of the overall cooking zone surface.

Advantageous embodiments of the inventive cooktop are to be considered as advantageous embodiments of the inventive method.

Further features of the invention will emerge from the claims, the figures and the description of the figures. The features and combinations of features mentioned above in the description and also the features and combinations of features cited subsequently in the description of the figures and/or simply shown in the figures are able to be used not just in the respectively cited combination but also in other combinations or on their own, without departing from the framework of the invention.

BRIEF DESCRIPTION OF THE DRAWINGS

Exemplary embodiments of the invention are explained in greater detail below with reference to schematic drawings, in which.

DETAILED DESCRIPTION OF EXEMPLARY EMBODIMENTS OF THE PRESENT INVENTION

Figure 1:
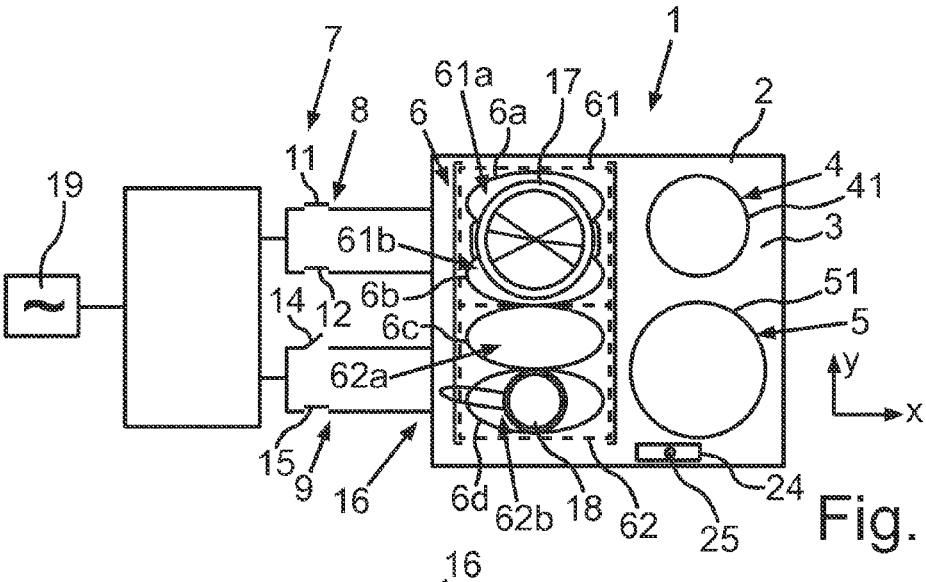
FIG. 1 shows a schematic overhead view of an exemplary embodiment of an inventive cooktop.

Elements which are the same or which function in the same way are provided with the same reference characters in the figures.

FIG. 1 shows a schematic diagram of an overhead view of a cooktop 1 having a support plate 2, which can be configured from glass or glass ceramic. Food preparation vessels, such as pans, pots or the like, can be placed on an upper face 3 of the support plate 2. In the exemplary embodiment the cooktop 1 comprises three cooking zones 4, 5 and 6, which differ in respect of their surface dimensions and their surface shape. Thus the cooking zones 4 and 5 are configured as circular in shape and have different radii. Their maximum surface size is indicated by means of the contours 41 and 51 of the cooking zones 4 and 5, with a user thus being able to identify where a heating element is located for the cooking zones 4 and 5 below the support plate 2 in these positions.

In the exemplary embodiment the cooktop 1 is configured as an induction cooktop, so that at least one inductor is configured below the cooking zones 4 and 5 in each instance. Provision is made in the exemplary embodiment for each of said inductors to have a single coil which is accordingly wound in the shape of a circle so that, on activation of the induction coil essentially the entire surface of the cooking zone 4 which is delimited by the contour 41 is able to be heated, and in respect of the cooking zone 5 which is delimited by the contour 51, this is likewise able to be heated by an induction coil. As can be seen from the diagram according to FIG. 1, the cooking zones cooking zones 4 and 5 are disposed spaced apart from one another, whereby they are also disposed spaced apart from the cooking zone 6.

Provision can also be made for at least one of the cooking zones 4 and 5 to comprise a number of induction coils which are able to be activated and deactivated separately and are configured as circles disposed within one another, so that these independent induction coils have different radii. This enables a cooking zone cooking zone 4 and 5 also to be heated in radially smaller and larger surface regions.

In addition the cooking zone 6 is configured as a particularly large cooking zone surface which in addition is also configured as rectangular in respect of its shape. In the embodiment shown the cooking zone 6 comprises four inductors disposed below the support plate 2, of which each inductor has a single induction coil. In respect of shape, these are disposed adjacent to one another and have an oval shape, as shown in FIG. 1. The inductors adjoin one another so that the heatable surface can be heated almost completely. The oval shape of the wound induction coils of the individual inductors 6*a*, 6*b*, 6*c* and 6*d* configured as heating units makes particularly regular surface heating possible. As can be seen, these inductors 6*a* to 6*d* with their induction coils are not disposed cascaded within one another but are adjacent to one another and all have the same geometrical dimensions.

In addition the cooktop 1 comprises an apparatus 16 for detecting a food preparation vessel on the cooking zones 4, 5 and 6. This is particularly to be seen in respect of the detection of a food preparation vessel on cooking zone 6 which is very large as regards its surface and is larger than the surfaces of cooking zones 4 and 5 together.

In particular the surface of the cooking zone 6 essentially extends over at least 80%, preferably at least 90% of the depth of the cooktop 1 and thus also of the support plate 2, meaning an extension in the y-direction. In addition the cooking zone 6 has a surface in the width (x-direction), which in the exemplary embodiment comprises at least 30%, preferably 40% of the overall widthways extension of the support plate 2.

The apparatus 16 preferably comprises a number of sensors which are configured to operate capacitively or inductively, so that occupancy can be detected reliably.

The cooktop 1 also comprises a circuit arrangement 7, which is configured to supply energy to the individual heating units of the cooking zones 4 to 6 and comprises the inductors 6*a* to 6*d*. The circuit arrangement in this context comprises a first driver circuit 8 and a second driver circuit 9 separate therefrom. The first driver circuit 8 is configured to supply energy to the two first heating units or inductors 6*a* and 6*b*. In addition the second driver circuit 9 is configured to supply energy to the two further heating units or inductors 6*c* and 6*d*. The two driver circuits 8 and 9 are able to be operated independently of one another.

In addition the cooktop 1 comprises a control unit which is assigned in a component-specific and functional manner to the circuit arrangement 7. By means of the control unit the individual inductors 6*a* to 6*d* are individually controlled and accordingly activated and deactivated and the signals of the apparatus 16 can be processed accordingly with this control unit.

Figure 2:
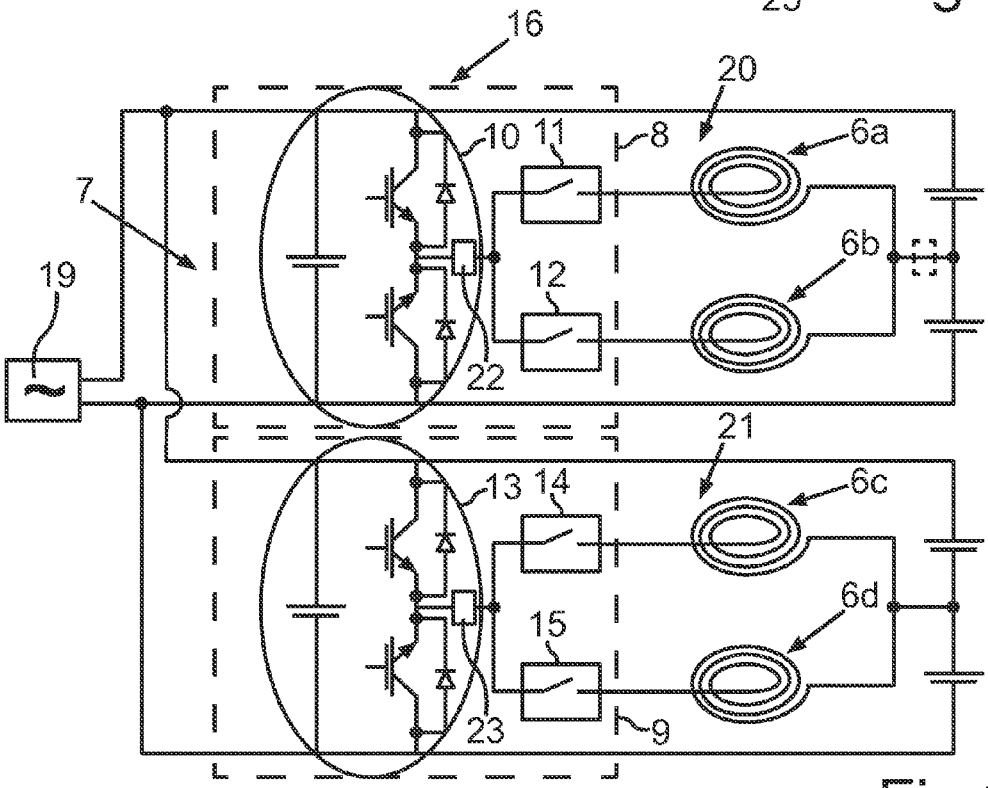
FIG. 2 shows a schematic simplified view of a circuit principle of the cooktop according to FIG. 1.

In respect of the specific structure of the circuit arrangement 7, reference is made to the simplified circuit diagram in FIG. 2. AC voltage for the circuit arrangement 7 is supplied via a power supply network 19. The first driver circuit 8 comprises a first half bridge circuit 10 which is connected in series to a parallel circuit 20. The parallel circuit 20 comprises a first circuit branch, in which a first relay 11 is connected in series to the induction coil of the inductor 6*a* and thus the first heating unit. A relay 12 is also connected in the second circuit branch parallel thereto, being connected in series to the induction coil of the second inductor 6*b* or the second heating unit.

In addition the second driver circuit 9 is constructed in a similar way to the first driver circuit 8 and likewise comprises a half bridge circuit 13, which is connected in series to a parallel circuit. This parallel circuit here too comprises a first circuit branch, in which a relay 14 is connected in series to an induction coil of the third inductor 6*c* or the third heating unit. In a second circuit branch a further relay 15 is connected in series to an induction coil of the fourth inductor 6*d* or the fourth heating unit. These secondary zones 61*a* and 61*b* essentially represent in terms of surface the size of the oval embodiments of the induction coils disposed thereunder, which are identified by the corresponding contours on the upper face 3 of the support plate 2.

In addition the second driver circuit 9 is constructed in a similar way to the first driver circuit 8 and likewise comprises a half bridge circuit 13, which is connected in series to a parallel circuit 21. This parallel circuit 21 here too comprises a first circuit branch, in which a relay 14 is connected in series to an induction coil of the third inductor 6*c* or the third heating unit. In a second circuit branch a further relay 15 is connected in series to an induction coil of the fourth inductor 6*d* or the fourth heating unit.

Connected in series to the parallel circuit 20 is a current measuring element 22. A circuit design is thus realized in which only one such current measuring element 22 is present in the first driver circuit 8, which is not connected in the parallel circuit 20 itself but in series to the parallel circuit 20. This enables an embodiment with a very much reduced number of components to be created. The current measuring element 22 is also assigned in a component-specific manner to the apparatus 16 for pot detection or for occupancy detection of the cooking zone. In a similar manner the second driver circuit 9 likewise has a current measuring element 23, which is connected in series to the parallel circuit 21.

In the exemplary embodiment the current measuring elements 22 and 23 of the separate driver circuits 8 and 9 are connected between the half bridge circuits 10 or 13 and the parallel circuits 20 or 21 respectively.

As indicated in the diagram according to FIG. 2, the current measuring element 22 could also be connected after the parallel circuit 20 in series to the parallel circuit 20, as symbolized by the dashed-line box. Similarly there could be provision for connection of the current measuring element 23 after the parallel circuit 21 and in series therewith.

According to the diagram shown in FIG. 1, in the exemplary embodiment the induction cooktop 1 also comprises an operating facility 24 which is configured on the cooktop plate or support plate 2.

This operating facility 24 can be configured at least partly as touch-sensitive. It can have a number of operating elements and in addition also include a display unit. In particular the operating facility 24 has an operating element 25 which can likewise be configured to be touch-sensitive. A user-defined activation of an occupancy detection check of the overall cooking zone 6 can be performed with this operating element 25.

As already explained at the outset, the large-surface cooking zone 6 is formed from a number of cooking sub-zones. In the exemplary embodiment two cooking sub-zones 61 and 62 are provided for this purpose, their corresponding zone surfaces being identified. These are configured as cohesive and directly adjoining one another. In the exemplary embodiment each of these cooking sub-zones 61 and 62 has two secondary zones 61*a* and 61*b* and also 62*a* and 62*b*. The surfaces of the secondary zones are so to speak defined as regards their dimensions by the coils of the inductors 6*a* to 6*d* wound in an oval shape or by their size.

In respect of the immediately adjacent arrangement of the cooking sub-zones 61 and 62 and also the secondary zones 61*a*, 61*b*, 62*a* and 62*b*, this is to be provided according to the diagram so that the surfaces delimited by the respective contours are disposed adjacent to one another without overlapping.

The induction cooktop 1 is configured so that at least the cooking zone 6 can be operated in two different operating modes. Provision is thus made in a first operating mode for the two cooking sub-zones 61 and 62, which form the overall cooking zone 6, to be operated together and thus to form the overall cooking surface of the cooking zone 6. In this first operating mode provision is made particularly for all cooking sub-zones 61 and 62 and particularly also the secondary zones 61*a*, 61*b*, 62*a* and 62*b* to be supplied with the same the electrical power. This relates during operation to the cooking sub-zones 61 and 62 or the formed secondary zones 61*a*, 61*b*, 62*a* and 62*b* occupied by a food preparation vessel 17 or 18. Provision is thus made for the inductors 6*a* to 6*b* assigned locationally and functionally in each instance to the secondary zones 61*a*, 61*b*, 62*a* and 62*b* only to be able to be supplied with the same power when this first operating mode is activated. This means that those inductors 6*a* to 6*d*, their assigned secondary zones 61*a*, 61*b*, 62*a* and 62*b* or the corresponding cooking sub-zones 61 and 62 on the support plate 2, which are occupied by a food preparation vessel 17 or 18, can only be supplied with the same electrical power.

In this first operating mode an occupancy detection check is performed by means of the apparatus 16, as explained later. Provision is made in the exemplary embodiment, on activation of the cooktop 1 and with a user-defined or automatically-started first operating mode of the cooking zone 6, for a first occupancy detection check to be performed automatically. If a food preparation vessel 17 or 18 is then detected at specific points, the inductors 6*a* to 6*d* occupied accordingly over the secondary zones 61*a*, 61*b*, 62*a*, and 62*b* are activated. If a further occupancy check is then also subsequently required or to be performed, this can only be started in a user-defined manner. To this end the user must actuate the operating element 25. An automatic second occupancy detection check and thus starting a second occupancy detection phase automatically is therefore not possible.

The cooking zone 6 is additionally able to be operated in its second operating mode, in that the cooking sub-zones 61 and 62 are able to be switched on and off independently of one another. In this second operating mode the cooking sub-zones 61 and 62 can also be operated independently of one another with different powers. In this second operating mode an overall cooking zone 6 does not exist so to speak and the cooking sub-zones 61 and 62 are to be seen as separate independent cooking zones, similar to the further cooking zones 4 and 5.

In respect of the procedure for operation of the cooktop 1 and in particular of the large-surface cooking zone 6, a multistage search method is performed in a method-specific manner in respect of occupancy detection in said first operating mode. For this purpose it is checked in a first step whether any food preparation vessel is disposed on the overall cooking zone 6, with only a superordinate search for occupancy being performed in this first search step and not a locationally specific search.

The cooking sub-zones 61 and 62 with their correspondingly indicated zone surfaces are formed in respect of number and size preferably as a function of the number of driver circuits 8 and 9. In the exemplary embodiment the first cooking sub-zone 61 is thus formed such that it represents around half of the overall cooking zone surface of the cooking zone 6 and in particular comprises the surfaces of the regions of the cooking zone 6, which can be heated with the first two inductors 6*a* and 6*b*. In a similar way the second cooking sub-zone 62 is formed so that it comprises the surface of the cooking zone 6, which can be heated by the further inductors 6*c* and 6*d*.

According to the first search step a check is thus initially made in a broad and superordinate search strategy for general occupancy of the cooking zone 6. In respect of this detection, low-voltage measurement signals are generated by the apparatus 16, which produce an oscillation in one of the series resonant circuits formed by the inductors 6*a* to 6*d* and the capacitors shown in the diagram. In this first search step all switching elements in the form of the relays 11 to 15 are closed. Correspondingly occurring current values are then detected by the current measuring elements 22 and 23, it being possible to detect from the current values whether at least one food preparation vessel is located somewhere on the cooking zone 6.

If it is established in this first step that at least one food preparation vessel is located on the cooking zone 6, then in a further subsequent search step a locationally precise search is performed to determine where the food preparation vessel is located exactly.

As a result of the circuit design shown in FIG. 2, in which only one current measuring element 22 or 23 is assigned in each instance to one of the driver circuits 8 and 9 and these are connected in a specific manner in series to the parallel circuits 20 or 21, a further search strategy is to be performed in this regard in a specific way.

To this end provision is then initially made for the relay 11 and the relay 14 to remain closed, while the relay 12 and the relay 15 are opened. Through this mode of operation it can be detected by way of the current measuring elements 22 and 23 whether a food preparation vessel is disposed above the inductor 6*a* and the inductor 6*c* and the corresponding secondary zone 61*a* or 62*a* is occupied.

In a further search step the relays 11 and 14 are then opened and the relays 12 and 15 closed. From the current values then likewise detected again by way of the current measuring elements 22 and 23, it can also be identified here whether food preparation vessels are located above the secondary zones 61*b* and 62*b*.

Provision can naturally also be made for the relays 11 and 14 to be initially opened and the relays 12 and 15 to remain closed and subsequently for the relays 11 and 14 then to be closed and the relays 12 and 15 opened.

As a function of these further search steps performed, it is then established at precisely which locationally specific positions of the overall cooking zone 6 a food preparation vessel is actually located.

Subsequently only the inductor 6*a* to 6*b*, of which the assigned secondary zone 61*a*, 61*b*, 62*a* or 62*b* is also specifically occupied by a food preparation vessel, is supplied with electrical energy by closing the relay 11 to 15 connected in series thereto.

The remaining inductors, of which the associated secondary zones are not occupied, are or remain deactivated.

Such an occupancy detection phase lasts about 5 seconds in the exemplary embodiment. During this period food preparation vessels 17 and 18 can be removed or placed on the cooktop and this is then also detected. If an occupancy detection phase has elapsed and correspondingly ended, then the additional placing of a food preparation vessel on the cooking zone 6 will not be detected and this further food preparation vessel will then also not be heated. Only if the user actively actuates the operating element 25 is a further occupancy detection check started and the food preparation vessel additionally placed on the cooktop after the first occupancy detection phase then detected.

It should also be mentioned that a food preparation vessel detected during an occupancy detection phase on the cooking zone in 6 in this first operating mode can be displaced on the cooking zone 6 (but not removed) after the occupancy detection phase has elapsed and this displacement will be detected. Those inductors 6*a* to 6*d* are then activated which are required to heat up the food preparation vessel at the new location, with those inductors 6*a* to 6*d*, which are now not occupied by comparison with the original position of the food preparation vessel before it was displaced, being deactivated.

In the diagram shown by way of example in FIG. 1 two food preparation vessels 17 and 18 are shown, which in terms of size are each smaller than a cooking sub-zone 61 or 62. The first operating mode of the cooktop 1 is particularly advantageous when a food preparation vessel is placed on the cooking zone 6, which is larger in terms of the surface that it covers than a cooking sub-zone 61 or 62. This is when this first operating mode is particularly advantageous since in the second operating mode overall heating of such a large food preparation vessel is so to speak not possible.

The secondary zones 61*a*, 61*b*, 62*a* and 62*b* shown by way of example are the same size in terms of surface and also identical in terms of their shape in the exemplary embodiment. Provision can also be made for at least one secondary zone to be configured as larger and/or with a different shape. This also depends particularly on the embodiment and size of the assigned inductor 6*a* to 6*d* disposed below.

The explanation of the multistage search method set out above can also be used for the specific exemplary embodiment shown in FIG. 2 such that after the broad and basic first detection of a food preparation vessel somewhere on the cooking zone 6, the subsequent search steps in the sub-regions relating to the cooking sub-zone 61 and the cooking sub-zone 62 are not carried out simultaneously, as explained above, but offset in time.

In respect of the exemplary diagram shown in FIG. 1 the relay 13 is opened, since no food preparation vessel is placed on the secondary zone 62*a*. The further secondary zones 61*a*, 61*b* and 62*b* are occupied by the food preparation vessels 17 and 18, so that the assigned inductors 6*a*, 6*b* and 6*d* disposed below them and thus below the cooktop plate or support plate 2 must be supplied with energy, to which end the relays 11, 12 and 15 are closed.

LIST OF REFERENCE CHARACTERS

1 Cooktop
2 Support plate
3 Upper face
4, 5, 6 Cooking zones
41, 51 Contours
6*a*, 6*b*, 6*c*, 6*d* Inductors
7 Circuit arrangement
8, 9 Driver circuits
10, 13 Half bridge circuits
11, 12, 14, 15 Relays
16 Apparatus
17, 18 Food preparation vessels
61 First cooking sub-zone
61*a*, 61*b* Secondary zones
62 Second cooking sub-zone
62*a*, 62*b* Secondary zones

The invention claimed is:

1. An induction cooktop, comprising:

a cooking zone comprising two cooking sub-zones;

a circuit arrangement for operating the cooking zone, said circuit arrangement having a parallel circuit in which two inductors are connected in a parallel manner, each of the two inductors corresponding to a different one of the two cooking sub-zones; and an apparatus configured to detect occupancy of at least one of the two cooking sub-zones by a food preparation vessel, said apparatus including a current measuring element connected in series to the parallel circuit.

2. The induction cooktop of claim 1, wherein the cooking zone is heated by at least three adjacently disposed inductors, with two of the inductors being supplied with electrical energy with a first driver circuit, and with at least a third one of the inductors being supplied with energy with a separate second driver circuit, wherein one of the inductors is activatable as a function of detection of a food preparation vessel on the cooking zone by way of said one inductor.

3. The induction cooktop of claim 2, wherein the second driver circuit is configured to supply a fourth inductor with energy.

4. The induction cooktop of claim 2, wherein the two inductors connected to the first driver circuit are activatable and deactivatable independently of one another.

5. A method for operating a cooking zone of an induction cooktop, forming at least two cooking sub-zones heatable by separate inductors, respectively, wherein the inductors are connected in a parallel manner in a parallel circuit, said method comprising:

connecting a current measuring element in series to the parallel circuit; and detecting occupancy of a cooking sub-zone by a food preparation vessel from current values captured by the current measuring element.

6. The method of claim 5, further comprising performing a multistage search to detect occupancy of the cooking zone.

7. The method of claim 6, further comprising connecting switching elements in series to the inductors, respectively, in the parallel circuit and closing the switching elements in a first search step to detect occupancy on the cooking zone, and detecting a basic occupancy of the cooking zone by a food preparation vessel from the current value at the current measuring element, independently of a precise location of the food preparation vessel on the cooking zone.

8. The method of claim 7, further comprising maintaining in a second search step the switching element connected in series to a first one of the inductors closed while opening the switching element connected in series to a second one of the inductors, and detecting from the current value at the current measuring element whether the first cooking sub-zone is occupied by a food preparation vessel, and opening in a third search step the switching element connected in series to the first inductor while closing the switching element connected in series to the second inductor, and detecting from the current value at the current measuring element whether the second cooking sub-zone is occupied by a food preparation vessel.

9. The method of claim 8, further comprising supplying, after occupancy detection, the inductors for the cooking sub-zones on which occupancy was detected with energy, and closing the switching elements connected in series to the inductors.

10. The method of claim 5, wherein the cooking zone is heated by at least three adjacently disposed inductors, further comprising supplying two of the inductors with electrical energy with a first driver circuit, and supplying at least a third one of the inductors with energy with a separate second driver circuit, wherein one of the inductors is activatable as a function of detection of a food preparation vessel on the cooking zone by way of said one inductor.

11. The induction cooktop of claim 1, wherein the two inductors are adapted to heat the food preparation vessel at different locations.

12. The induction cooktop of claim 1, further comprising a cooking surface, wherein the two inductors are disposed below the cooking surface and do not overlap one another when viewed from the cooking surface towards the two inductors.

13. The induction cooktop of claim 1, wherein neither inductor of the two inductors is completely enclosed by the other.

14. The induction cooktop of claim 1, wherein the two inductors are laterally adjacent to one another.

15. The induction cooktop of claim 1, wherein each of the two inductors has only one coil.

16. The method of claim 5, wherein the two cooking sub-zones are adapted to heat the food preparation vessel at different locations.

17. The method of claim 5, wherein the two cooking sub-zones do not overlap one another when viewed from the cooking vessel towards the two cooking sub-zones.

18. The method of claim 5, wherein neither of the separate inductors is completely enclosed by the other.

19. The method of claim 5, wherein the separate inductors are adjacent to one another.

20. The method of claim 5, wherein each of the separate inductors has only one coil.

* * * * *